United States Patent [19]

Kaiser et al.

[11] 4,296,161

[45] Oct. 20, 1981

[54] DRY-FORMED NONWOVEN FABRIC

[75] Inventors: Paul H. Kaiser, Glenolden; Rudolf Neuenschwander, Swarthmore, both of Pa.; Henry J. Norton, Wilmington, Del.

[73] Assignee: Scott Paper Company, Philadelphia, Pa.

[21] Appl. No.: 191,235

[22] Filed: Sep. 26, 1980

Related U.S. Application Data

[63] Continuation of Ser. No. 93,526, Nov. 13, 1979, abandoned.

[51] Int. Cl.[3] ..... B32B 5/14

[52] U.S. Cl. ..... 428/171; 428/288; 428/297; 428/299; 428/303; 428/537

[58] Field of Search ..... 428/171, 288, 297, 299, 428/303, 537

[56] References Cited

U.S. PATENT DOCUMENTS

| | | | |
|---|---|---|---|
| 2,926,417 | 3/1960 | Duvall | 428/360 |
| 3,663,348 | 5/1972 | Liloia et al. | 428/171 |
| 3,669,778 | 6/1972 | Rasmussen | 156/62.2 |
| 3,862,472 | 1/1975 | Norton et al. | 19/305 |
| 4,064,600 | 12/1977 | Gotchel et al. | 19/306 |
| 4,097,965 | 7/1978 | Gotchel et al. | 19/306 |
| 4,130,915 | 12/1978 | Gotchel et al. | 19/304 |
| 4,134,948 | 1/1979 | Baker | 428/171 |

*Primary Examiner*—James J. Bell

*Attorney, Agent, or Firm*—Joseph H. Yamaoka; William J. Foley

[57] ABSTRACT

A dry-formed nonwoven fabric; preferably an air lay web; including a fiber composition which is at least 50%, by weight, wood pulp fiber less than about 0.635 cm (¼ inch) in length with 25% or more of the fiber composition in the web, by weight, being kraft wood pulp fibers, and under 50%, by weight, reinforcing fibers intermixed with the wood pulp fibers throughout the web structure; an embossment in the web providing a plurality of compressed, densified valley regions and less-dense high loft regions; the web including no more than about 5.1 g/m² (3.0 lbs per ream of 2,880 ft.²) of a binder and having a cross machine direction wet tensile strength no lower than about 0.09 Kg/cm (0.5 lbs/inch), and preferably at least 0.107 Kg/cm (0.6 lbs/inch). A higher cross-machine direction wet tensile strength in excess of 0.267 Kg/cm (1.5 lbs/inch) can be established at a binder level less than 8.5 g/m² (5 lbs/ream), and preferably at a binder level between 6.8–8.5 g/m² (4–5 lbs/ream).

13 Claims, 1 Drawing Figure

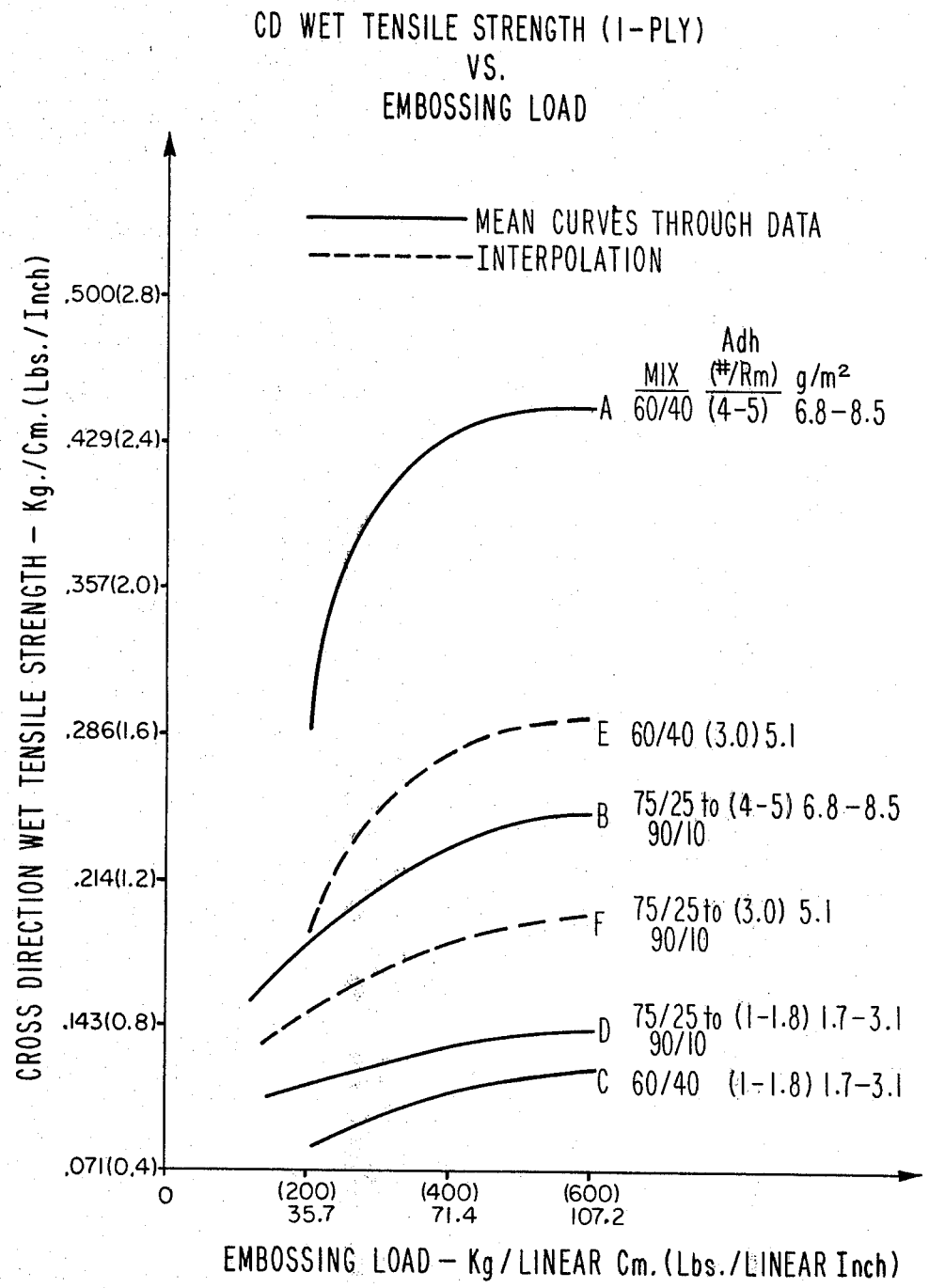
CD WET TENSILE STRENGTH (1-PLY)
VS.
EMBOSSING LOAD
MEAN CURVES THROUGH DATA
INTERPOLATION
CROSS DIRECTION WET TENSILE STRENGTH - Kg./Cm. (Lbs./Inch)
.500(2.8)
.429(2.4)
.357(2.0)
.286(1.6)
.214(1.2)
.143(0.8)
.071(0.4)
0
(200) 35.7
(400) 71.4
(600) 107.2
EMBOSSING LOAD - Kg/LINEAR Cm. (Lbs./LINEAR Inch)
MIX
Adh (#/Rm)
g/m²
A 60/40 (4-5) 6.8-8.5
E 60/40 (3.0) 5.1
B 75/25 to 90/10 (4-5) 6.8-8.5
F 75/25 to 90/10 (3.0) 5.1
D 75/25 to 90/10 (1-1.8) 1.7-3.1
C 60/40 (1-1.8) 1.7-3.1

DRY-FORMED NONWOVEN FABRIC

This is a continuation, of application Ser. No. 93,526 filed Nov. 13, 1979 now abandoned.

TECHNICAL FIELD

This invention relates generally to a dry-formed nonwoven fabric, and more particularly to a unique air lay web structure employing a blend of wood pulp fibers and reinforcing (e.g., textile) fibers.

BACKGROUND ART

Air lay web forming technology has developed to the point where it is now being used commercially to manufacture a variety of absorbent web products. For example, Scott Paper Company has developed an air lay process in which wood pulp fibers and textile fibers are blended together to manufacture webs for use in impregnated baby wipes, household towels and a variety of industrial wipers. These textile fibers enhance web strength by reinforcing the structure. In addition, Scott owns a number of patents directed to its blended-fiber, air lay technology (e.g., U.S. Pat. Nos. 4,134,948; 4,130,915; 4,097,965 and 4,064,600). This list of patents does not include all patents directed to Scott's air lay technology; however, it is representative of information relevant and material to the subject matter of the instant invention.

Johnson & Johnson also has developed an air lay technology for manufacturing absorbent webs from a blend of wood pulp fibers and textile fibers. This technology purportedly utilizes the suction bonding technique described in U.S. Pat. No. 3,663,348, issued to Liloia et al., to bond the webs throughout their thickness, and purportedly is being commercially utilized to manufacture the facing sheet of Johnson & Johnson's disposable diaper product. This technology also may have been employed at different times to manufacture other absorbent web products.

Karl Kroyer of Denmark has developed an air lay technology employing 100% wood pulp fibers in forming air lay webs. In other words, Kroyer's technology does not employ textile fibers blended with the wood pulp fibers to reinforce the web structure. This technology presently is being utilized by American Can Company to commercially manufacture a household towel under the Bolt trademark, and purportedly employs the method claimed in U.S. Pat. No. 3,669,778, issued to Rasmussen.

In the commercial products employing blended fiber compositions (i.e., wood pulp fibers and textile fiber) relatively large quantities of binder have been needed to establish the necessary strength levels; particularly for absorbent products encountering rigorous use (e.g., household wipers, industrial wipers, etc.). In fact, the prior art technology employed by Scott Paper Company to manufacture its household and industrial wipers relies upon the use of approximately 8.5–10.2 g/m$^2$ (5–6 lbs. per ream 2,880 ft.$^2$) of a cross-linking latex binder to establish a cross-direction wet tensile strength that does not fall below 0.107 Kg/cm (0.6 lbs. per inch). Although for some applications a lower cross-direction wet tensile strength on the order of about 0.089 Kg/cm (0.5 lbs./inch) can be tolerated, a high binder level in excess of about 6.1 g/m$^2$ (3.6 lbs./ream) would still be needed.

The need for high binder levels is even more acute in air lay webs formed from 100% wood pulp fibers, since no additional strength will be imparted to these webs by longer-length textile fibers. For example, the commercial use of Kroyer's technology, as is partially reflected in earlier-referenced Rasmussen U.S. Pat. No. 3,669,778, to manufacture Bolt household towels utilizes in excess of 13.6 g/m$^2$ (8 lbs./ream) of binder to establish a cross-machine direction wet strength level of about 0.135 kg/cm (0.76 lbs./in).

Liloia et al. U.S. Pat. No. 3,663,348, assigned to Johnson & Johnson, suggests the use of low binder levels in air lay web structures. However, in order to achieve desired strength levels Liloia et al. appears to require the use of reinforcing synthetic fibers having a substantially uniform length greater than 1.9 cm (¾ inches), and a suction bonding technique for bonding the entire web throughout its thickness.

The webs described in the Liloia et al. examples are not embossed, and there is absolutely no teaching that any relationship exists between the magnitude of embossing pressure and strength. However, such a relationship has surprisingly been recognized by applicant, and has been made use of in inventing the products covered herein, as will be explained in greater detail later in this application. It is significant to note that even though specific examples in the Liloia et al. patent suggest the use of low binder levels less than 3.4 g/m$^2$ (2#/ream), commercial products purportedly covered by this patent employ considerably higher levels above 8.5 g/m$^2$ (5 lbs. per ream) to obtain a CDWT level of about 0.14 kg/cm (0.8 lb/in).

A further patent of interest relating to air-lay fibrous webs including blends of wood pulp fibers and longer-length fibers, is U.S. Pat. No. 2,926,417, issed to Duvall. The webs disclosed in Duvall are primarily intended for use as flexible insulation and cushioning felts and are not embossed. Duvall definitely does not suggest any relationship between the magnitude of embossing pressure and strength; a relationship that need to be recognized by applicant in making the instant invention. Duvall indicates that to provide sufficient strength in his web to permit it to be conveyed through a bonding operation without falling apart, he needs to include at least 20% textile-length fibers in the structure. Interestingly, the blended fibrous webs of the instant invention can include considerably less than 20% textile fibers and still be carried through a bonding operation in a reliable manner.

DISCLOSURE OF INVENTION

A dry-formed nonwoven fibrous web includes a fiber composition which is at least 50%, by weight, wood pulp fibers less than about 0.635 cm (¼ inch) in length, with 25% or more of the fiber composition in the web, by weight, being kraft wood pulp fibers, and under 50%, by weight, reinforcing fibers intermixed with the wood pulp fibers throughout the web; an embossment in the web providing a plurality of compressed, densified valley regions and less-dense high loft regions, said web including no more than about 5.1 g/m$^2$ (3.0 lbs./ream of 2,880 sq. ft.) of binder and having a cross-machine direction wet tensile strength (CDWT) of at least about 0.107 Kg/cm (0.6 lbs. per linear inch). With less than 8.5 g/m$^2$ (5 lbs/ream) of binder a cross-machine direction wet tensile strength in excess of 0.267 Kg/cm (1.5 lbs/linear inch), and actually in excess of 0.356 Kg/cm (2.0 lbs/linear inch) can be achieved.

It has been found that for a given blend of wood pulp fibers and textile fibers, and for a given quantity of binder (i.e. g/m$^2$), variations in web basis weight in the range of about 51 g/m$^2$ (30 lbs/ream) to about 119 g/m$^2$ (70 lbs/ream) have very little effect on strength levels. In addition the Duvall U.S. Pat. (No. 2,926,417) indicates that variations in web basis weight in the range of about 340 g/m$^2$ (200 lbs/ream) to about 510 g/m$^2$ (300 lbs/ream) also have very little effect on strength levels. Basis weight will have a greater influence on strength (for a given fiber mix and binder level) at lower basis weight levels. The particular basis weight level where this becomes significant, and therefore needs to be taken into account in determining the quantity of binder that is needed to maintain, or establish a particular strength level, can be determined quite easily by empirical means.

Preferably over 50% of the fiber composition in the web, by weight, is kraft wood pulp fibers. Preferably these wood pulp fibers are predominantly softwood, and are northern kraft wood pulp fibers that impart greater strength to the web than coarser southern kraft wood pulp fibers. A northeastern kraft wood pulp fiber, such as Pictou, is preferred since it is finer than its northwestern counterparts, and provides a stronger web construction. Although not desiring to be limited to any particular theory, it is believed that the higher strength levels are achieved since the finer northeastern kraft wood pulp fibers provide more fiber crossover points per unit area that can be bonded together in the dry-formed web structure.

Preferably the fibrous web of this invention is manufactured by an air lay web forming process of the type described and claimed in U.S. Pat. No. 3,862,472, issued to Henry J. Norton and Brian E. Boehmer, and assigned to Scott Paper Company. The process preferably is carried out with a fiber blending device of the type described in either U.S. Pat. No. 4,064,600 or U.S. Pat. No. 4,130,915, both issued to Gotchel, et al. and assigned to Scott Paper Company. After the initial web of blended wood pulp fibers and longer-length reinforcing fibers is formed it is embossed in accordance with unique aspects of this invention; is thereafter bonded through the application of a spray binder to both surfaces of the web and is subsequently cured.

The embossing operation is carried out between a steel roll containing the desired embossing patern etched into it, and an opposed rubber covered roll against which the web is pressed. By embossing at a pressures of approximately 24.11 kg/cm (135 lbs. per linear inch) or higher Scott Paper Company has been able to reduce the amount of binder applied to the web by more than one-half the amount previously employed, while still maintaining desired minimum cross direction wet strength levels. In fact this can be achieved in a web construction in which secondary, or manufacturers waste textile fibers are employed as reinforcing fibers, as opposed to uniform length synthetic fibers of the type required for use in the Liloia et al. web construction. In addition, these minimum CDWT levels can be achieved in web constructions which are not bonded throughout their entire thickness; at least in the high loft regions.

To further emphasize the significance of this invention, a prior art air lay web construction employing southern Kraft wood pulp fibers blended with secondary textile-length fibers required the use of approximately 10.2 g/m$^2$ (6 lbs. per ream) of a cross-linking binder to achieve a CDWT level of no less than about 0.107 Kg/cm (0.6 lbs./in.). In the instant invention this minimum CDWT level, as well as higher CDWT levels in excess of 0.179 Kg/cm (1 lbs./in.) can be established at a binder level of no more than bout 5.1 g/m$^2$ (3 lbs. per ream). This invention is made possible by applicant's recognition that an increase in embossing pressure, at least in the range of from about 17.86 Kg/cm (100 pli) to at least about 107 Kg/cm (600 pli), has a significant effect in increasing the strength of webs formed from a blend of wood pulp fibers and longer reinforcing fibers. This was quite surprising to discover since a similar effect has not been encountered in air lay web structures in which the fiber composition is 100% wood pulp. In fact, FIG. 3 of earlier-referred-to Rasmussen U.S. Pat. No. 3,669,778, along with the textual material, teaches that very little increase in strength can be expected by embossing a 100% wood pulp air lay web at pressures in excess of 17 Kg/cm (95 pli).

BRIEF DESCRIPTION OF THE DRAWINGS

The FIGURE in this application is a plot of cross direction wet tensile strength versus embossing pressure for webs having different fiber mixes and adhesive levels.

BEST MODE FOR CARRYING OUT THE INVENTION

The sole FIGURE in this application illustrates the interrelationships among fiber mix (i.e., percentage, by weight, of wood pulp fibers/percentage, by weight, of reinforcing textile fibers), adhesive level, strength level and embossing pressure. The data plotted in the FIGURE is set forth in TABLE 1.

In all samples the wood pulp was Pictou northeast kraft-approximately 85% softwood/15% hardwood.

The textile fiber was manufacture's waste polyester, sold under designation 1280A by Leigh Company of Spartansburg, South Carolina. This fiber has an average length of about 1.9 cm (¾ inches), and has a random length distribution that was not classified in any way prior to being deposited into the air-laid web construction.

The binder was Reichhold 97460, a self-crosslinking styrene-butadiene latex; purchased as a emulsion containing about 45% solids. The emulsion was diluted to 14–20% solids for spray application.

The average moisture level, by weight, of the air-laid mat immediately after embossing was greater than 15% and less than 30%..

The embossing operation was carried out between an upper pattern roll and a lower anvil roll. The upper roll was about a 46 cm (18 inch) diameter, fluted heat-transfer roll made of steel. It was internally heated by oil flow through internal channels, and the surface temperature of the roll was about 22° C. (40° F.) below the average oil temperature. Surface temperature of the upper roll was maintained between about 79.4° C. (175° F.) and 101° C. (215° F.) during embossing. The upper roll was engraved with standard Terri pattern #201 having about 80% lofted, or raised areas for forming the compressed valley regions in the webs of this invention. The spacing between raised areas in this pattern is less than the average length of the textile fibers, and therefore the textile fibers will interconnect the compressed valley regions in the web to become an effective strength imparting component of the structure.

The lower anvil roll was about a 46 cm (18 inch) diameter steel roll, covered with a 1.59 cm (⅝ inch) outer layer of rubber having a Shore A hardness of 95.

The upper and lower rolls were brought into contact with each other by means of a piston-actuated mechanism. The load plotted in the FIGURE (kg per linear centimeter) was calculated by dividing the total load applied to the roll by the axial dimension of the roll.

TABLE I

| | Fiber Mix +% wood pulp/ % textile fibers | Adhesive g/m² (lbs/ream) | Embossing Load Kg/linear cm (lbs./linear inch) | CDWT (1-ply) Kg/cm (lbs./in.) | Basis Weight g/m² (lbs/ream) |
|---|---|---|---|---|---|
| Curve A | 60/40 | 6.8-8.5 (4-5) | 35.7 (200) | .285 (1.60)* | (67.5) |
| | " | " | 71.4 (400) | .433 (2.43)* | (71) |
| | " | " | 107.2 (600) | .443 (2.49)* | (72.5) |
| Curve B | 75/25 | " | 35.7 (200) | .204 (1.14)* | (61.1) |
| | " | " | 71.4 (400) | .227 (1.27)* | (63.2) |
| | 80/20 | " | 35.7 (200) | .170 (0.95)* | (52) |
| | " | " | 71.4 (400) | .234 (1.31)* | (51.9) |
| | " | " | 107.2 (600) | .246 (1.38)* | (56.2) |
| | 90/10 | " | 20.2 (113) | .163 (0.91)* | (43.8) |
| | " | " | 25.5 (143) | .152 (0.85)** | (38.3) |
| | " | " | 26.8 (150) | .146 (0.82)* | (37.9) |
| | " | " | 42.9 (240) | .179 (1.00)** | (43.9) |
| Curve C | 60/40 | 1.7-3.1 (1-1.8) | 35.7 (200) | .082 (0.46)* | (66.3) |
| | " | " | 71.4 (400) | .113 (0.63)* | (65.3) |
| | " | " | 107.2 (600) | .120 (0.67)* | (68.1) |
| Curve D | 75/25 | " | 71.4 (400) | .134 (0.75)* | (66.9) |
| | " | " | 107.2 (600 ) | .147 (0.81)* | (66.3) |
| | 80/20 | " | 35.7 (200) | .102 (0.57)* | (50.4) |
| | " | " | 71.4 (400) | .107 (0.60)* | (54.8) |
| | " | " | 107.2 (600) | .143 (0.80)* | (54.2) |
| | 90/10 | " | 24.1 (135) | .104 (0.58)* | (44.8) |
| | " | " | 26.8 (150) | .118 (0.66)*** | (41.4) |
| | " | " | 107.2 (600) | .141 (0.79)*** | (38.9) |

Curves E & F are interpolations from A-C and B-D, respectively; based on a linear relationship existing between strength and increase in adhesive load.

[30]Pictou - NE kraft pulp, about 85/15 soft/hardwood

*Value is a single data point which is an average of tests carried out on 16 plies by making four determinations; each with a 4-ply sample.

**Value is an average of two data points; each data point being generated as indicated above.

***Value is an average of six data points; each data point being generated as indicated above.

The most significant fact represented in the FIGURE is that web strength (CDWT) can be increased significantly by increasing embossing pressure; at least within the range of from about 20 Kg/cm (110 pli) to at least about 107 Kg/cm (600 pli). This effect is most pronouced at adhesive levels of approximately 5.1 g/m² (3 lbs./ream) and 6.8-8.5 g/m² (4-5 lbs./ream) (curves A, B, E and F); and is somewhat less pronounced at 1.7-3.1 Kg/m² (1-1.8 lbs./ream) (curves C & D). However, even at these low adhesive levels of 1.7-3.1 g/m² (1-1.8 lbs/reams) the increase in strength resulting from increasing the embossing pressure is a significant finding in this invention.

The relationship between strength and embossing pressure within the embossing pressure range of approximately 20 Kg/cm (110 pli) to 107 Kg/cm (600 pli) was quite unexpected; particularly in view of the teaching in the Rasmussen patent that such a phenomena does not take place in a 100% wood pulp fiber web.

Because of the discovered relationship between strength and embossing pressure in air-lay webs formed from blends of wood pulp fibers and reinforcing fibers, applicants have been able to establish the same minimum CDWT levels at less than one-half the binder level previously employed. Alternatively, by using conventinal prior art binder levels applicants can achieve twice the CDWT levels previously obtained.

Significantly, as indicated in the FIGURE, applicants can establish CDWT levels no lower than about 0.107 Kg/cm (0.6 lbs/inch) at binder levels of 5.1 Kg/m² (3.0 lbs/ream) and less, e.g. about 1.7-3.1 g/m² (1-1.8 lbs./reams) by suitably increasing the embossing pressure. This is true for all of the tested webs having a 60/40 mix (i.e., wood pulp/textile fiber) to 90/10 mix.

Prior to this invention adhesive levels of 8.5-10.2 g/m² (5-6 lbs/ream) were employed in Scott Paper Company's blended fiber air lay webs to insure that CDWT levels did not fall below about 0.107 Kg/cm (0.6 lbs/inch). However, in accordance with this invention applicants can employ less than 8.9 g/m² (5 lbs/ream) of binder; preferably in the 6.8-8.5 g/m² (4-5 lbs/ream) range, to establish CDWT levels in excess of 0.267 Kg/cm (1.5 lbs/linear inch), and actually in excess of 0.356 Kg/cm (2.0 lbs/linear inch).

Another extremely significant fact represented in the FIGURE is that merely increasing the percentage of textile fibers will not necessarily increase web strength (compare curves C and D). Stating this somewhat differently, there appears to be a relationship between binder add-on and textile fiber composition in establishing web strength. Although curve C is representative of webs having a greater percentage of textile fibers than the webs represented by curve D, the webs represented by curve C are weaker at binder add-on levels of 1.7-3.1 g/m² (1-1.8 lbs/ream). However, this is not the case at the higher binder levels of 5.1 g/m² (3.0 lbs/ream) and 6.8-8.5 g/m² (4-5 lbs/ream), at least in the range of about 36-107 Kg/linear centimeter (200-600 pli) embossing pressure. In this latter situation compare curve A with curve B, and curve E with curve F.

The precise reasion is not understood for the decrease in strength of webs having a 60/40 mix at 1.7-3.1 g/m² (1-1.8 lbs/ream) binder add-on (curve C), compared to similarly bonded webs having a lower textile fiber composition (curve D). Although not wishing to be bound to a specific theory, applicants believe that the following may reflect what has taken place. The denser the compressed areas of the embossed structure, the greater the number of cross-over points that exist to be captured, or bound into the structure by a unit amount of binder. The strength of the product is directly related to the number of bonded cross-over points that are established. Textile fibers are more elastic than damp wood pulp fibers, and therefore are inherently less capable of being set in a compressed condition than the wood pulp fibers. Because of this resilience increasing the textile fiber level will decrease the density in the compressed areas of the structure, and thereby provide less cross-over points that can be captured by the unit amount of binder. At lower binder levels this can actually result in a decrease in web strength, as is evidenced by company curve C with curve D. However, when there is sufficient binder to bond the textile fibers together in the web structure, there will be a strength benefit achieved by increasing the percentage of textile fibers relative to the wood pulp fibers. This is evidenced by comparing curve A with curve B, and curve C with curve D.

As a result of discovering the above relationship between strength, the percentage of textile fibers in the web and the level of binder in the web, applicants have formed lower binder add-on webs having optimum strength with small percentages of textile fibers. Thus a more cost competitive, higher strength web can be produced, compared to a low-binder add-on web in which the percentage of textile fibers is increased in an effort to increase strength. In particular applicants can form air-lay webs having CDWT levels in excess of 0.09 Kg/cm (0.5 lbs/in.) and even in excess of about 0.107 Kg/cm (0.6 lbs./in.), with 1.7–3.1 g/m$^2$ (1–1.8 lbs/ream) of binder add-on and a 90/10 mix of wood pulp fibers to textile fibers.

The following Table II sets forth five (5) examples that are illustrative of the instant invention, and these examples are not intended to limit the scope of coverage. The claims appended hereto define the limits of the instant invention.

TABLE II++

| No. | Mix Wood+ | Mix Textile+++ | Adhesive g/m$^2$ (lbs/Rm.) | Embosser Load Kg/linear cm (lbs/lin. inch) | CDWT Kg/cm (lbs/inch) | Basis Weight g/m$^2$ (lbs/Rm.) |
|---|---|---|---|---|---|---|
| 1* | 90 | 10 | 2.04 (1.20) | 24.1 (135) | .10 (0.58) | 76.21 (44.83) |
| 2** | 90 | 10 | 1.97 (1.16) | 107.2 (600) | .14 (0.79) | 66.16 (38.92) |
| 3* | 60 | 40 | 2.60 (1.53) | 35.7 (200) | .08 (0.46) | 112.66 (66.27) |
| 4* | 60 | 40 | 2.60 (1.53) | 71.4 (400) | .11 (0.63) | 110.93 (65.25) |
| 5* | 60 | 40 | 2.60 (1.53) | 107.2 (600) | .12 (0.67) | 115.75 (68.09) |

+Pictou = NE Kraft pulp, about 85/15 soft/hard wood
++line speeds: ex. 1–68 meters/minute; ex. 2–70 meters/minute: exs. 3 through 5–54 meters/minute
+++1280A - manufacturer's polyester waste sold by Leigh Company.
*Value is a single data point which is an average of tests carried out on 16 plies making four determinations; each with a 4-ply sample.
**Value is an average of six data points; each being determined as indicated above.

Applicants have found that the desired minimum CDWT can be obtained by using secondary or waste reinforcing fibers in the web structure, as opposed to using the uniform length synthetic fibers in excess of 1.9 cm (¾ inch) disclosed by Liloia et al. "Secondary textile fibers" or "waste fibers" as is used by applicants includes within its scope such fibers as cotton thread waste, jute waste, cotton napper waste, reclaimed tire cord and wool napper flock. It should be understood that other secondary fibers may be employable in this invention. Although these secondary fibers generally have less reinforcing capabilities than the uniform length synthetic fibers utilized by Liloia et al., these secondary fibers can be employed in the instant invention to achieve the desired minimum CDWT levels indicated herein.

The use of lower levels of binder in the web structures of this invention provides both a significant cost benefit, and also enhances the ability of the web to wipe-up liquids from wet surfaces; particularly when fine northeast Kraft wood pulp fibers are employed to aid in establishing the desired capillary structure to pick-up and retain the liquids. Moreover, since applicants do not saturation bond their webs as is disclosed by Liloia et al., interior regions of the web; particularly in high loft regions, are generally free of binder, and therefore are highly absorbent. The inclusion of binder throughout the thickness of the web is noted by Liloia et al as having an adverse effect on absorbent properties. Furthermore, the use of low binder levels improves the "hand" of the product, reduces streaking (i.e., the leaving of a white film on wiped surfaces) and minimizes linting. All of these advantages are obtained without sacrificing strength.

Having described our invention we claim:

1. A dry-fornmed nonwoven fibrous web including a fiber composition which is at least 50%, by weight, wood pulp fibers less than about 0.635 cm (¼ inch) in length with 25% or more of the fiber composition in the web, by weight, being kraft wood pulp fibers, and under 50%, by weight, reinforcing fibers intermixed with the wood pulp fibers throughout the web structure; an embossment in the web providing a plurality of compressed, densified valley regions and less-dense high loft regions, said web including no more than about 5.1 g/m$^2$ (3.0 lbs per ream of 2,880 ft.$^2$) of a binder and having a cross machine direction wet tensile strength of at least about 0.107 Kg/cm (0.6 lbs./inch).

2. The nonwoven web of claim 1 wherein at least 50%, by weight, of the fiber composition is kraft wood pulp fibers.

3. The nonwoven web of claim 2 wherein the wood pulp fibers are northeastern Kraft wood pulp fibers and the reinforcing fibers are secondary textile fibers.

4. The nonwoven web of claim 2 or 3 having a cross machine direction wet tensile strength of at least about 0.179 Kg/cm (1.0 lbs./inch).

5. The nonwoven web of claim 2 wherein the reinforcing fibers constitute from about 10–40%, by weight, of the fiber composition of the web structure.

6. The nonwoven web of claim 2 wherein the binder incompletely penetrates the web at least in high loft regions.

7. A dry-formed nonwoven fibrous web including a fiber composition which is at least 50%, by weight, wood pulp fibers less than about 0.635 cm (¼ inch) in length with 25% or more of the fiber composition in the web, by weight, being kraft wood pulp fibers, and under 50%, by weight, reinforcing fibers intermixed with the wood pulp fibers throughout the web structure; an embossment in th web providing a plurality of compressed, densified valley regions and less-dense high loft regions, said web including no mre than about 3.1 g/m$^2$ (1.8 lbs/ream of 2,880 ft.$^2$) of a binder and having a cross direction wet tensile strength of at least about 0.093 Kg/cm (0.5 lbs./inch).

8. The nonwoven web of claim 1 wherein at least 50%, by weight, of the fiber composition is kraft wood pulp fibers.

9. The nonwoven fibrous web of claim 8 wherein the cross direction wet tensile strength is at least about 0.107 Kg/cm (0.6 lbs./linear inch).

10. The nonwoven web of claim 8 wherein the wood pulp fibers are northeastern Kraft wood pulp fibers and the reinforcing fibers are secondary textile fibers.

11. The nonwoven web of claim 8 or 10 wherein the reinforcing fibers constitute from about 10–40%, by weight, of the fiber composition of the web structure.

12. The nonwoven web of claim 8 wherein the binder incompletely penetrates the web at least in high loft regions.

13. The nonwoven web of claim 11 wherein the reinforcing fibers comprise 10%, by weight, of the fiber composition of the web structure.

* * * * *